US006778918B2

(12) United States Patent
Delhomme et al.

(10) Patent No.: US 6,778,918 B2
(45) Date of Patent: Aug. 17, 2004

(54) METHODS FOR MONITORING FLUID FRONT MOVEMENTS IN HYDROCARBON RESERVOIRS USING PERMANENT SENSORS

(75) Inventors: Jean-Pierre Delhomme, Boulogne Billancourt (FR); Yves Manin, Le Plessis Robinson (FR); Marwan Charara, Paris (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/434,916

(22) Filed: May 9, 2003

(65) Prior Publication Data

US 2003/0220750 A1 Nov. 27, 2003

(30) Foreign Application Priority Data

May 24, 2002 (GB) ..... 0212015

(51) Int. Cl.[7] ..... G01L 7/00

(52) U.S. Cl. ..... 702/50; 73/382 G; 356/72; 324/357; 166/250.01

(58) Field of Search ..... 702/6, 7, 9, 11, 702/12, 13, 50, 100; 73/152.39, 382 G; 166/250.01, 308; 250/227.14; 356/72

(56) References Cited

U.S. PATENT DOCUMENTS 6,125,698 A * 10/2000 Schweitzer et al. ..... 73/382 G
6,268,911 B1 * 7/2001 Tubel et al. ..... 356/72
6,473,696 B1 * 10/2002 Onyia et al. ..... 702/6
6,531,694 B2 * 3/2003 Tubel et al. ..... 250/227.14
6,588,266 B2 * 7/2003 Tubel et al. ..... 73/152.39
6,609,067 B2 * 8/2003 Tare et al. ..... 702/9
6,644,402 B1 * 11/2003 Sharma et al. ..... 166/250.01

* cited by examiner

*Primary Examiner*—John Barlow
*Assistant Examiner*—John Le
(74) *Attorney, Agent, or Firm*—J. L. Jennie Salazar; Brigitte L. Echols; John Ryberg

(57) ABSTRACT

A method of monitoring a fluid front movement is provided. The method includes: determining at least two techniques for monitoring the fluid front movement; determining a configuration of monitoring sensors, corresponding to the at least two monitoring techniques, from a joint sensitivity study of the at least two techniques; acquiring data with the monitoring sensors; and monitoring the fluid front by joint inverting the data.

12 Claims, 10 Drawing Sheets

METHODS FOR MONITORING FLUID FRONT MOVEMENTS IN HYDROCARBON RESERVOIRS USING PERMANENT SENSORS

BACKGROUND OF THE INVENTION

The present invention relates to hydrocarbon reservoir management. More specifically the present invention relates to monitoring fluid front movements in hydrocarbon reservoirs.

DESCRIPTION OF RELATED ART

In a hydrocarbon reservoir, oil is produced through wells, under pressure of gas, water, or compaction. Water may be naturally present in the reservoir displacing the oil to urge it out through the well bores. Often, additional water is injected into the reservoir from injection bore located near the production bore. As oil is extracted from production wells, the water moves through the porous medium of the formation, and the oil-water interface changes shape. If the location of the fluid fronts (especially the oil-water interface) is not monitored during production, it is possible that the well will rapidly start producing a mixture of oil and water. In some cases, it is possible for the well to produce more water than oil. One important challenge for reservoir management is therefore to monitor fluid movements in hydrocarbon reservoirs in view of optimizing their drainage.

Well logs are traditionally the primary source of information used to map the distribution of fluids in hydrocarbon reservoirs. Because of the high electrical resistivity of hydrocarbons compared to formation or injection water, open hole well logs of resistivity are typically used to infer water saturation, the percentage of pore volume occupied by water, a quantity that dramatically changes across the oil-water front. Measurement of fluid pressures is also used to estimate multiphase fluid flow properties (e.g. water and oil mobilities) and, indirectly through numerical simulation of reservoir flow, to assess the location of the oil-water interface.

U.S. Pat. No. 5,467,823 (Babour et al., 1995) addresses long-term monitoring of hydrocarbon reservoirs and discloses the use of permanent downhole sensors for monitoring reservoir pressure, but without specifically disclosing fluid front monitoring.

U.S. Pat. No. 5,642,051 (Babour et al., 1997) discloses the use of permanent downhole electrodes to monitor the position of a hydrocarbon/water interface. The '823 patent does not specifically address the issue of monitoring the location of the oil-water interface and neither patent discloses any method for interpreting data acquired by the sensors in order to predict the location of the oil-water interface over time.

U.S. Pat. No. 6,061,634 (Belani et al., 2000) disclosed a method for performing a pressure-resistivity inversion for data acquired with a logging tool run into a borehole and not by way of using permanent downhole sensors. In a permanent reservoir monitoring context, U.S. Pat. No. 6,182,013 (Malinverno et al., 2001) disclosed a method for interpreting resistivity and pressure measurements acquired simultaneously during a fall-off test after an injection period and dynamically estimating the location of an oil-water interface. This patent is limited to pressure and DC or AC resistivity measurements. All of the above-mentioned patents suffer of certain shortcomings. Either they do not provide solutions for front monitoring or they relate in isolation to permanent sensor monitoring techniques independent of one another, or, maybe more importantly, they don't mention how to properly address the sensor selection and installation design issues that are critical ones.

It is thus desirable to provide comprehensive method and apparatus that permit not only to evaluate how the various possible monitoring techniques individually perform in a given monitoring situation, but also that synergistically combine data obtained with these techniques, so as to achieve the best possible efficiency in fluid front tracking.

SUMMARY OF THE INVENTION

One embodiment of the present invention provides a method of monitoring a fluid front movement. The method includes: determining at least two techniques for monitoring the fluid front movement; determining a configuration of monitoring sensors, corresponding to the at least two monitoring techniques, from a joint sensitivity study of the at least two techniques; acquiring data with the monitoring sensors; and monitoring the fluid front by joint inverting the data.

DETAILED DESCRIPTION OF INVENTION, INCLUDING EXAMPLES

The present invention provides a synergistic combination of several physical principles for monitoring saturation changes in a hydrocarbon reservoir (or in other words, fluid front displacements) that complement one another. In one embodiment, arrays of resistivity sensors (either electrodes or coils), 3-component geophones, and pressure gauges are concurrently deployed in producers, injectors or observation wells, and operated in time-lapse mode. Repeated electrical, seismic, and pressure buildup surveys coupled with joint time-lapse inversion techniques, that may be based on a Bayesian approach, provide information on the front movement. Specifically, a pressure gauge and an electrode or geophone array may be jointly used to track a water front movement towards a producing well, combined with a proposed interpretation approach, which inherently accounts for the fact that resistivity or seismic monitoring are gradually taking over from pressure monitoring for providing information related to the front when the front is approaching.

It has been found that resistivity, acoustic and pressure-monitoring techniques differ in the way they interact with static and dynamic reservoir characteristics. For example, water salinity affects the resistivity contrast between oil and water zones, whereas oil viscosity affects mobility contrast across the contact between the two phases at the front, and thereby the pressure transient response during shut-in tests. The different monitoring techniques also differ in the way they are probing the reservoir: spherically with current injection electrodes or acoustic sources, cylindrically with well shut-in tests. Combining several monitoring techniques may lead to larger problem coverage and improved (more reliable) front positioning (estimate of location) during the whole front displacement monitoring process.

The types of sensors that may be used in the framework of the embodiment of the present invention include resistivity (either electrodes for DC-type measurements, or coils for AC-type ones), pressure (gauges located either inside wells or in direct contact with the reservoir), acoustics or seismic (3-components geophones in direct contact with either the well casing or the reservoir itself), and also possibly temperature (either distributed or localized measurements that may use optic fibers) sensors.

Figure 1:
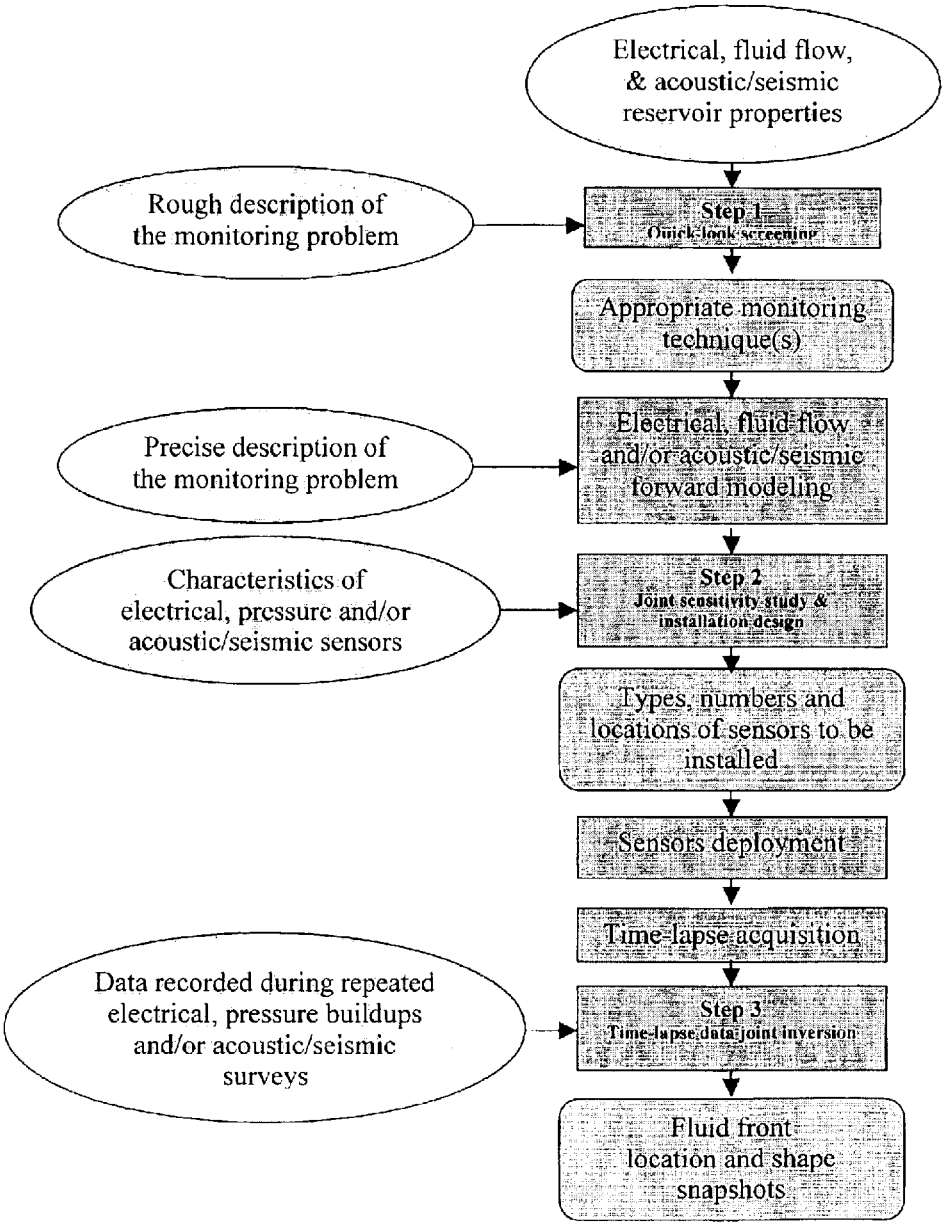
FIG. 1 shows a workflow for a method according to an embodiment of the invention.

One embodiment of the method according to the present invention includes 3 steps shown in the flowchart of FIG. 1.

Step 1 includes a problem screening technique for a quick assessment of the sensitivity of the various possible sensors to a particular monitoring problem. At this step a rough description of the monitoring problem is made. For example, the problem may be the monitoring of a injection front coming towards a vertical producing well at some distance away, in a layered reservoir; or, it may be the monitoring of a water table raising toward a horizontal producing well located above, in the oil-bearing zone, or any other situations when the monitoring may be achieved from an observation or an injection well. Information about electrical, fluid flow, and acoustic/seismic reservoir properties such as resistivity, mobility, or bulk density and compressional velocity is assumed known from prior measurements, e.g. open-hole logs. An appropriate monitoring technique, such as electrical, pressure, etc., or a combination of techniques, is selected, utilizing the above mentioned information known from open hole logs and charts such as those described hereafter.

At step 2, a precise description of the monitoring problem is provided where actual data relevant to the problem at stake, such as layer thickness(es), electrical conductivity (ies) of the layer(s) , etc. are provided, for example from logging data. Step 2 includes a sensitivity analysis based on forward modeling techniques that provide results about the expected sensor responses, such as voltage, acceleration, and pressure, for the example of the sensors mentioned above, for the problem at stake and for a given hypothetical sensor configuration. In this second step of the invention, the types, numbers and locations of the sensors to be deployed downhole may be determined: for example the number and spacing of electrodes, as well as the distance between seismic source and receivers is optimized , in order to get optimal sensitivity, that may be maximal sensitivity, to front movements.

At step 3, sensors have been deployed (installed), based on the sensitivity analysis results generated at step 2 and on the decisions that may be made according to these results and time-lapse data acquisition is being performed. A joint inversion technique is provided at this third step of the embodiment of the method of the present invention which, after sensor installation and time-lapse data acquisition, reconciles all types of data to better estimate the shape and location changes of the monitored front with time.

In order to more easily explain the best manner of performing the invention, a simplified reservoir monitoring case-study is considered hereafter, and the basic physical principles and theoretical sensitivity of each monitoring technique is recalled, using the following example.

Figure 2:
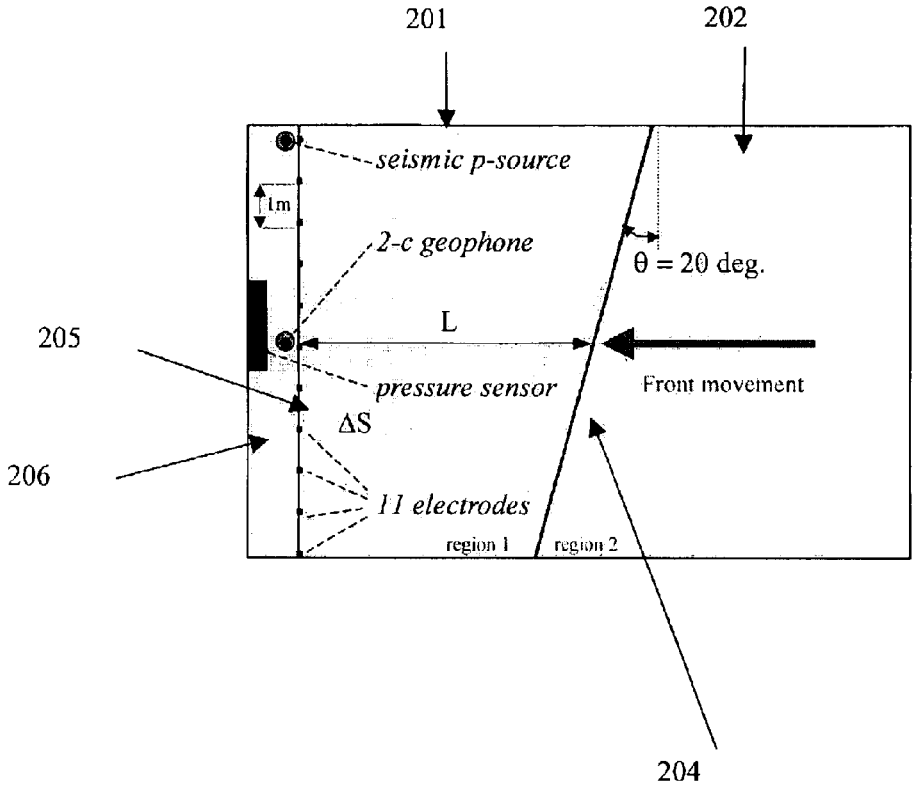
FIG. 2 shows a schematic view of the use of multiple sensors to monitor the advance of a water front.

FIG. 2 illustrates an apparatus for monitoring a waterfront 204 according to one embodiment of the present invention. The apparatus, which may be permanently installed in a well such as a production well, for purposes of this description, between a casing and the borehole is used for monitoring the advance of a tilted, sharp, planar waterfront 204 in a massive, weak, oil-bearing sandstone reservoir, towards the oil-producing well. In one example discussed herein, the slope of the waterfront is 20 degrees relative to the dotted line shown in the figure. (FIG. 2). The apparatus includes in one embodiment three kinds of sensors but the present invention is not limited in scope to this number of sensors or the type of sensors described hereafter. The apparatus includes in one embodiment thereof: an array of electrodes 206 mounted along an electrically insulated portion of the metal casing 205, a two-component (horizontal and vertical) geophone located next to a seismic source, and a pressure gauge located inside the well that is perforated over the whole reservoir. The embodiment of the apparatus illustrated in FIG. 2 includes 11 electrodes cemented with a 1-meter spacing $\Delta S$, while the geophone is located approximately 5 meters below a seismic P-source.

Data are to be acquired in a time-lapse manner. For the sake of simplifying the explanations, it will be assumed hereafter that electrical, seismic and pressure data are collected at time intervals corresponding to approximately 10-meter movements of the front. The sharp planar front divides the reservoir into two regions: the oil zone or region 201, where only the connate water is present ($S_w=S_{wc}$) and the water zone or region 202, situated behind the front and characterized by a water saturation equal to $(1-S_{or})$ $S_{or}$ being the residual oil saturation.

Electrode array measurements use, in turn, each electrode as a current source, while monitoring voltage at the other electrodes. In one embodiment, during a DC electrical survey, an electrical current injection electrode acts as a point source and the front plane 204 separating hydrocarbon 201 and water 202 zones defines two half-spaces that have different electrical properties (formation resistivity). The location of the front plane influences the electrical potential (voltage) measured at an electrode away from the injecting one.

Figure 3:
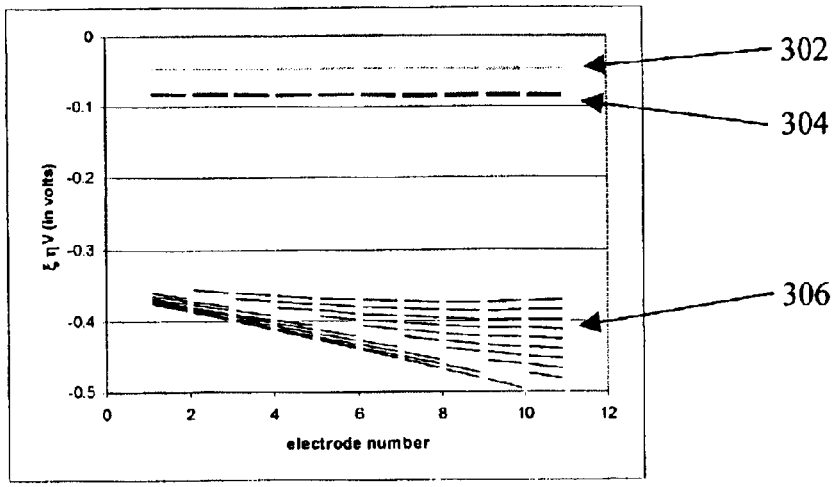
FIG. 3 shows a plot of voltages measured for the waterfront at different distances from electrodes in a well.

FIG. 3 displays the values of $\Delta V$ (i.e., of $(V(L)-V_{ref})$, where V is the electrical voltage recorded at time $\tau$, $L(\tau)$ being the horizontal distance at time $\tau$ from the well to the front at mid-reservoir and $V_{ref}$ is the voltage response for a front at infinity), for $L(\tau)$=90, 50 and 10 meters (302, 304, 306). Each survey generates 2N(2N+1) possible data ($\Delta V$), 2N+1 being the number of electrodes (=11 in the example presented herein).)

The sensitivity to the front distance of the electrical monitoring technique is given by the partial derivative of $\Delta V$ (i.e., of $V(L)-V_{ref}$) with respect to L. This sensitivity varies as $1/L^2$, which is characteristic of a point source. Apart from this effect, the main parameter affecting the sensitivity of electrode array measurements is the resistivity contrast between flooded and non-flooded zones: the higher this contrast, the higher the sensitivity of the electrical survey. This technique is very effective for tracking the advance of a hydrocarbon/water front (the higher the water salinity, the better).

A high resistivity of the interval where electrodes are installed is also favorable since, for a given current intensity, it contributes to an increase in the sensitivity. Coupled with the need for a high contrast between the zones on both sides of the front, the electrical monitoring technique is particularly suitable for reservoirs with high porosity, a low connate water saturation and low residual oil saturation.

Other particularly good candidates for electrical monitoring are the monitoring of the coning of a salty aquifer and of the advance of an injected brine front. Another particularly favorable case for electrical monitoring is salty connate water ring displaced ahead of the front by injected fresh water.

For the same problem, time-lapse downhole pressure buildup tests may also be performed: the principle is to repeatedly shut-in the producer well and to use a downhole pressure gauge in order to record the transient pressure response during the buildup periods.

Figure 4:
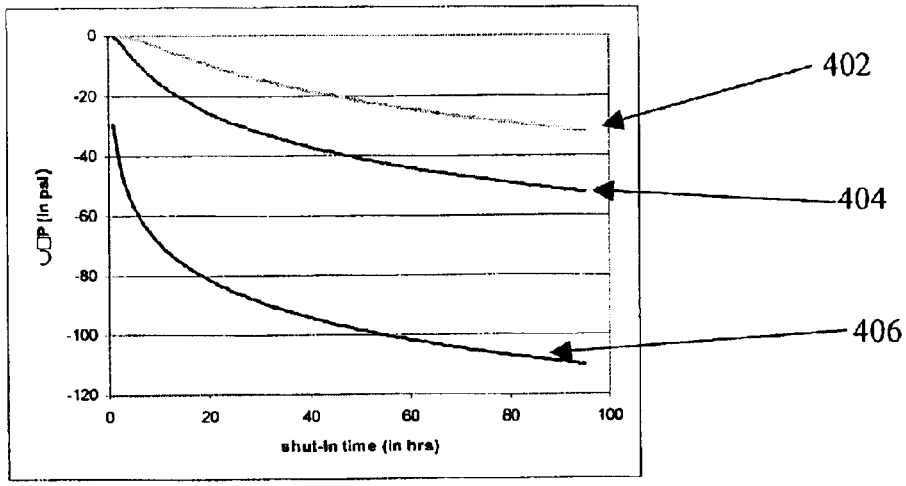
FIG. 4 shows a plot of pressures measured for the waterfront at different distances from pressure sensors in a well.

The well, that is supposed to be fully perforated, now acts as a line source. But, the presence of a sharp change in the rock/fluid properties (formation transmissivity) at the front location also affects this pressure response. FIG. 4 displays the values of $\Delta\Delta P(\Delta t)$ (i.e., of the difference between the observed pressure buildup $\Delta P$ and the one with the front at infinity $\Delta Pref$) as a function of $\Delta t$, i.e. for buildup times after shut-in ranging from 0 to 4 days, for $L(\tau)$=90, 50 and 10 meters (402, 404, 406).

For the pressure buildup technique, the sensitivity is given by the partial derivative with respect to the waterfront distance L of $\Delta\Delta P$ varies as 1/L, since the well acts as a line source and, it is a direct function of the contrast in mobility between the two zones.

The pressure technique is therefore particularly appropriate for gas/liquid (either oil or water) front tracking. For oil/water fronts, the higher the oil/water viscosity ratio, the higher the sensitivity of the measurement; the technique is hence particularly well suited for rather viscous oil.

A low transmissivity is also favorable since, for a given flow rate, it increases the sensitivity, which is also in support of low porosity reservoirs. High residual oil saturation behind the front is detrimental to the sensitivity, as it tends to decrease the mobility contrast between the two zones.

Again, for the same problem, time-lapse seismic surveys can be performed: the principle is to repeatedly emit a pressure wave with an explosive (or implosive) seismic source, in this case located downhole. Due to the sharp change in the formation elastic properties at the front location, the wave is partially reflected and the reflected wave is recorded as seismic traces by receivers, also located downhole.

In practice, the seismic source could either be a borehole source, with receivers in the same well at some distance from the source, as in this example, or it could also be located downhole but with the borehole source in one well and receivers in nearby wells, as in cross-well surveys, or even be located at surface, as in time-lapse Vertical Seismic Profiling (VSP)s.

Figure 5:
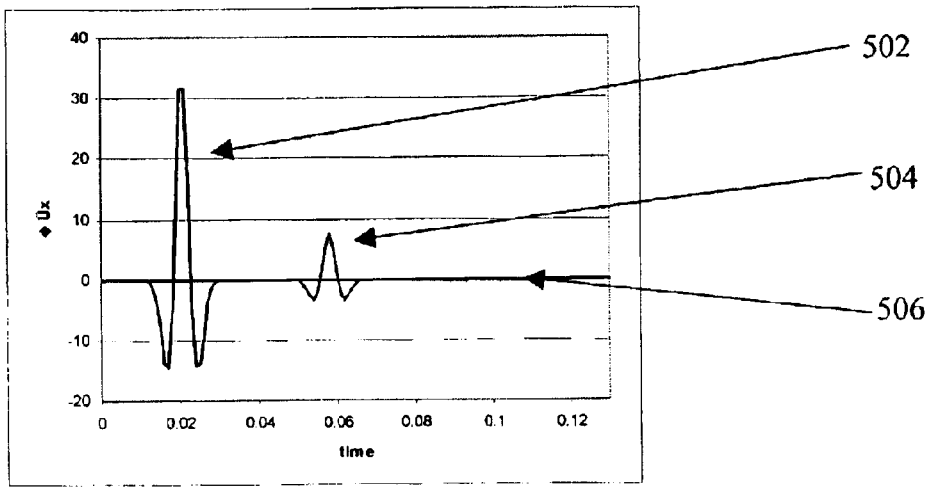
FIG. 5 shows a plot of seismic traces measured for the waterfront at different distances from a well.

FIG. 5 displays the values of $\Delta\ddot{U}$ (t) (i.e., of the difference between the observed accelerations $\ddot{U}$ and the one with the front at infinity $\ddot{U}$ref) in the x-direction, for $L(\tau)$=90, 50 and 10 meters (502, 504, 506). For the seismic monitoring technique, the sensitivity to the front distance is given by the partial derivative of $\Delta\ddot{U}x$ (i.e. of $\ddot{U}_X-\ddot{U}_X$ ref), |with respect to the water front distance L. This sensitivity primarily varies as $1/L^2$ and it is a direct function of the contrast in effective seismic properties between the two zones. i.e. a function of the ratio of the acoustic impedances (i.e., the bulk density $\rho$ times the p-wave (i.e. compressional) velocity $V_p$) between the two regions. It can be further expressed by a function of porosity, dry rock compressibility, fluid compressibility contrast and fluid saturation change across the front, through the Gassmann's equations.

High porosity that tends to weaken the rock is a positive factor. Reservoirs such as unconsolidated sandstones, with weak elastic frames, display larger changes in effective compressibility for similar changes in pore fluid conditions. Conversely, in general, carbonates are not good candidates for seismic fluid monitoring because they are very incompressible, have low porosity, and hence may give little response to pore fluid changes.

When a liquid (oil or water) is replaced by gas (or steam), the pore fluid compressibility increases dramatically. By comparison, the replacement of oil by water is more difficult to observe because of usually similar fluid compressibilities. If the oil is light or live (i.e., with dissolved gas), the compressibility contrast between the oil and the injected water may nevertheless be high, since most live oils are much more compressible than fresh water or brine, especially when the oil's gas-to-oil ratio is high. But, if the oil is relatively heavy (below 25 API) and dead, the compressibility contrast may be small.

a—Step 1: Quick-look Screening

With regard to the method summarized in FIG. 1, the first step of the embodiment of the method of the present invention includes a quick-look screening of the practical reservoir-monitoring problem at stake, to determine the most a priori sensitive monitoring technique(s) which may be electrical, pressure, or seismic, or the most appropriate combination of techniques. The screening may be performed by using generic sensitivity analyses pre-computed on simplified cases, for instance the one mentioned right above of sharp tilted planar fronts". Other examples of generic cases that could be considered are, for instance a front displaying fingers (more rapid advance in certain layers), or a cylindrical front geometry around an injection well. In one embodiment of the method of the present invention, tool(s), such as the triangular sensitivity charts presented in FIGS. 6*a* and *b* are prepared, based on these pre-computed generic sensitivity analyses. The triangular sensitivity charts are obtained by drawing three lines that connect every two of the three apexes. Each apex of the triangle corresponds to one of the three possible front monitoring methods. Any particular type of reservoir may be expressed as a given point within such a chart.

Triangular charts may be used that express information about one constitutive element of the reservoir, such as the fluid element or the rock element or combine both. The way those charts can be constructed from pre-computed sensitivity analyses is best explained by For example, in FIG. 6*a*, only fluid factors are addressed: the bottom leftmost apex corresponds to the highest fluid viscosity contrast, the bottom rightmost apex corresponds to the highest fluid density contrast, while the upper apex corresponds to the highest fluid resistivity contrast. Now, the closer the point, broadly defining the problem at stake, within the triangle to one of the apexes, the higher the sensitivity to the specific monitoring method corresponding to the respective apex: when the reservoir is characterized by a high fluid viscosity contrast, the pressure monitoring method is most appropriate for determining the fluid front. Similarly when the reservoir is characterized by a high fluid resistivity contrast the electrical monitoring method is most appropriate, while when the reservoir is characterized by a high fluid density contrast the seismic monitoring method is most appropriate. Similarly, FIG. 6*b* illustrates how a sensitivity triangular chart could be built with respect to the rock factors of the reservoir.

Figure 6A:
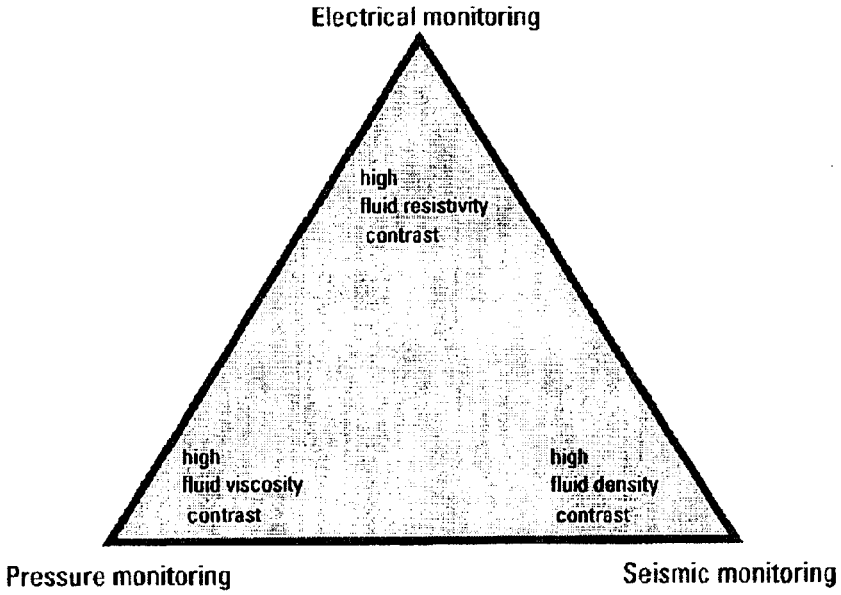
FIG. 6*a* shows a chart of sensitivity to fluid factors.
Figure 6B:
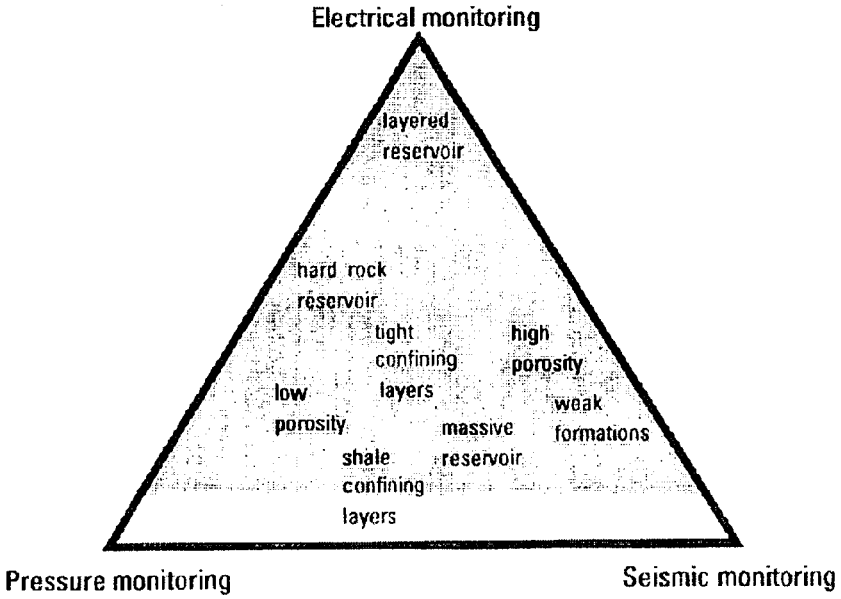
FIG. 6*b* shows a chart of sensitivity to rock factors.
Figure 7A:
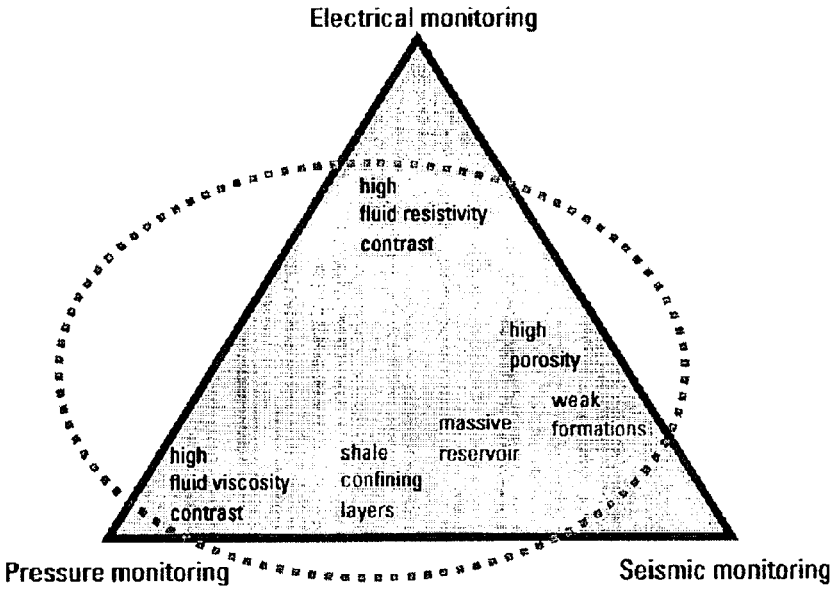
FIG. 7*a* shows an example of quick-look screening.
Figure 7B:
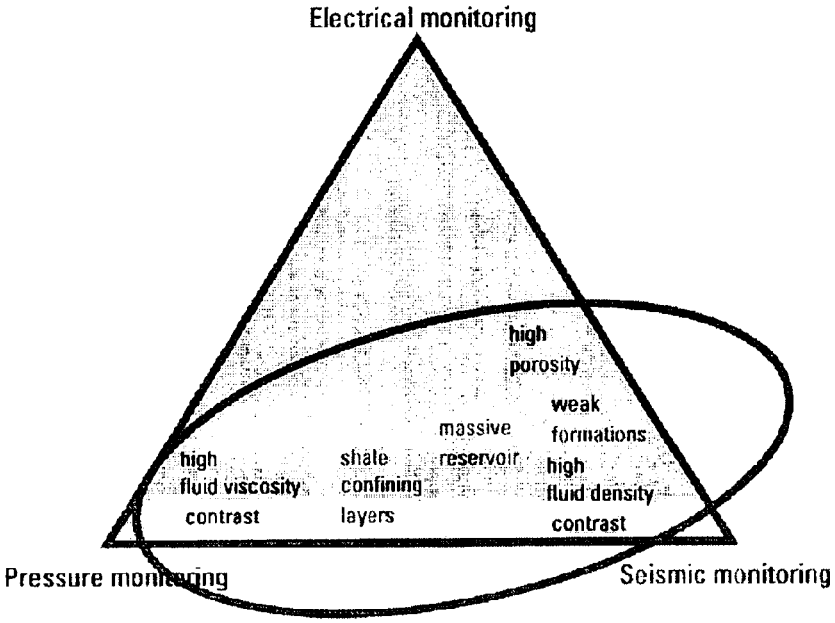
FIG. 7*b* shows the application of quick-look screening to a gas sandstone reservoir.
Figure 7C:
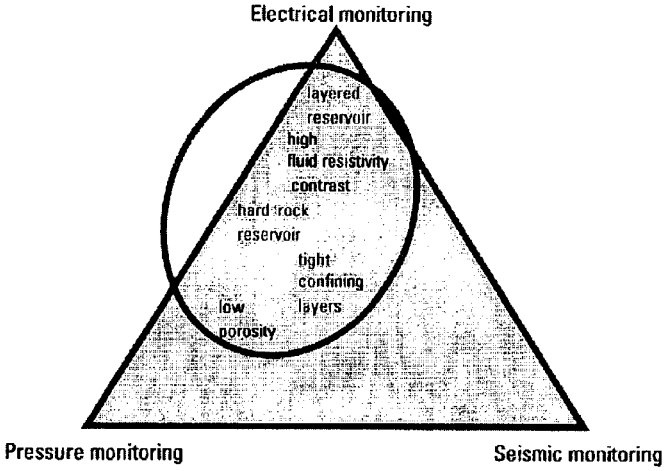
FIG. 7*c* shows the application of quick-look screening to an oil carbonate reservoir.

FIG. 7*a* shows how a chart such as the ones illustrated in FIGS. 6*a* and *b* may be used. For example, for the case illustrated in FIG. 7*a* where the reservoir is in a state found within the dotted line, all three monitoring methods may equally be applied. FIGS. 7*b* and *c* show how, depending upon cases (specifically gas sandstone reservoirs and oil carbonate reservoirs), one or two technique(s) could be more appropriate than the other(s).

Additional charts, dealing with the expected front distance range, may be conceived and used to complement the above-mentioned charts dealing with rock and fluid conditions. For example, it was shown above, that the pressure measurement sensitivity was proportional to 1/L, while the electrical one was proportional to $1/L^2$. When the reservoir characteristics are such that both techniques may equally apply, the sensitivity would be better with the pressure measurement when the front is far away and with the electrical measurement when the front approaches at short distances.

b—Step 2: Joint Sensitivity Study, and Installation Design

Once the above-described screening mechanism has provided guidelines for the technique(s) to be preferably used, the second step of the embodiment of the present invention described herein, determines the types of sensors, as well as their number and locations where the sensors may be best deployed downhole. For example, one may optimize the number and spacing of electrodes, as well as the distance between seismic source and receivers.

The applicability of each (and/or of a combination of several) technique(s) to the practical reservoir-monitoring problem at stake is further evaluated through a joint sensitivity analysis based on specific forward modeling exercises and the design parameters (sensor numbers and spacings) are optimized so as to maximize the sensitivity to the expected front movement to be monitored. The forward modeling techniques to be used in step 2 may, in rare instances, be analytical, as for the tutorial example with a sharp planar front. However, for a planar but gradational contact, the calculations for electrical monitoring may be less straightforward and a pseudo-analytical solution may be used to compute the potential at the monitoring electrode. More generally, numerical modeling techniques may be used. The forward model computation of sensor responses in terms of voltage, pressure build-up or particle acceleration may be achieved, in the embodiment of the present invention described herein, through the use of discretizaton schemes and numerical equation solving techniques. Resorting to numerical simulation techniques permits to quantify, at that stage, the influence of factors such as reservoir layering characteristics. For example, the pressure buildup technique may be evaluated as a function of the connectivity between layers, or of the risk that cross-flow takes place during the buildup period.

Figure 8A:
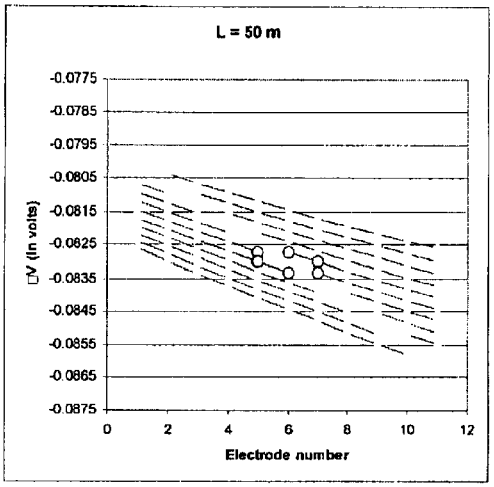
FIGS. 8*a* and 8*b* show plots of voltages measured by electrode arrays for a waterfront at 50 m and 10 m respectively.
Figure 8B:
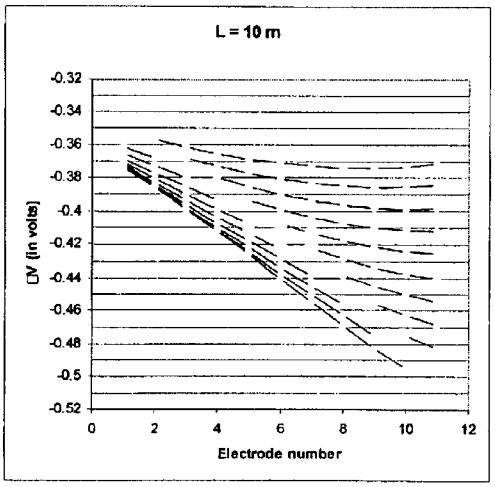

Another aspect of Step 2 is related to the determination of the types, numbers, and locations of sensors to be installed. Knowing that for each possible monitoring technique there is an expected signal-to-noise ratio that can be derived from hardware considerations, (each expected sensor response is compared to this expected noise level, when optimizing the sensor arrays. Without limiting the scope of the present invention, but only for description purposes, FIGS. 8*a* and 8*b* illustrate the results of electrical surveys with electrodes located downhole 1 m apart, their number only being optimized. With a waterfront located 50 meters away from the electrode array (FIG. 8*a*), forward modeling indicates that the data acquired with a 3-electrode array (highlighted) would be within a 0.001-volt range, while the data acquired with a 10-electrode array would all lie within a 0.01-volt range: depending upon the expected noise level, the information brought by a 3-electrode array, and even by a 10-electrode one, may be insufficient, if one considers that the expected noise level could be in the 0.01-volt range. The useful information would be lost in the noise. With a waterfront located 10 meters away (FIG. 8*b*), the information carried by data acquired with a 3-electrode array (highlighted) would now be sufficient since data now clearly plot outside the expected, say 0.01-volt noise range. Thus, expected noise level is to be used as a constraint in the sensor number and spacing optimization process.

Such optimization may be performed for each type of monitoring, independently, as shown above for electrical data, or may be preferably performed jointly for a combination of 2 or 3 techniques. The optimization process also includes deployment feasibility analysis. For instance, for the pressure buildup technique, it has been determined that vertical reservoir heterogeneity may not be a favorable factor as a saturation front will tend to propagate unevenly in a vertically heterogeneous formation. A proper description of the front would thus require good vertical resolution, and therefore a high sensor density across the reservoir. This may be more easily achieved with electrodes, than with pressure gauges due to their cost and dimensions. Electrode arrays are therefore more adapted to layered reservoirs, though they may be subject to constraints on the minimum possible electrode spacing, to fit with a standard completion.

Other similar technical issues may also be handled at this stage. For example, the time needed to perform a survey may matter: for instance, unlike an electrical or seismic survey, a pressure buildup survey would require to stop production for the duration of the buildup, unless the pressure gauge is located in a pulsing injection well, instead of a pulsing producer. This issue is linked with the expected noise level:

with low quality pressure gauges, very early portions of the buildup curves may not reflect the front discontinuity with enough strength for the front signature to be above the noise level. In our tutorial example, the pressure buildup data is taken as the pressure value measured after an elapsed shut-in time of 48 hours, but one day or even a few hours would be acceptable shut-in times, in most cases.

c—Step 3: Joint Inversion of Time-lapse Data

The third step of the embodiment of the method of the present invention addresses the interpretation of data recorded after sensor deployment, during repeated electrical and/or acoustic/seismic surveys, and/or pressure buildups.

Inverse theory comprises a wide variety of numerical techniques that may be used in the framework of the embodiment of the present invention described herein. One approach for methods utilizing the time-lapse aspect is "data assimilation": one proceeds sequentially in time as new data is collected with fitting the new data deriving from new observations to modify the reservoir model state parameters, so as to be as consistent as possible with both the new data and the previous information. The Kalman filter method is a good example of such a sequential approach to optimal estimation, combining model prediction with observations in a way that minimizes the estimation error. More generally, information obtained at previous surveys may be used as prior information in a Bayesian approach (relying on Bayes Theorem). For more on the application of the Bayes Theorem to fluid front monitoring and probability calculations applying to fluid front monitoring please refer to U.S. Pat. No. 6,182,013 issued to Malinverno and assigned to Schlumberger Technology Corporation, Ridgefield Conn.

Another approach that may be used for the joint inversion of data coming from surveys that use different physical principles is "data fusion". A Bayesian framework is also often adopted and may be chosen for the embodiment of the present invention set forth herein At each survey time, the current front location (e.g. distance L) and geometry (e.g. tilt angle θ in our simplified case-study) is inferred from a mathematical inversion of the last acquired data sets which in the examples provided above include voltage, pressure, and acceleration. Repeated calculations of the sensor response forward models (and derivatives) are used to estimate either a single set of front parameter values, such as L and θ, in one embodiment, that best fit the observed data, i.e. that maximizes over the admissible range of model parameters, the posterior PDFs (probability density functions) derived from the prior PDFs and the likelihood functions: in simple words, one looks for the most probable front parameter values, given the observed data.

For the example set forth herein, let us consider a single survey time τ, let us call $d_\tau$ either the electrical, seismic or pressure data recorded at time τ and let us assume that these data contain normally distributed, uncorrelated, additive noise with respective standard deviations $\sigma_\tau$. The two parameters that the data must be inverted for are the distance L and the slope θ of the waterfront. For either the electrical, pressure or seismic problem taken separately, the corresponding likelihood function may be written as:

$$L(m_\tau, \sigma_\tau \mid d_\tau) \propto \exp\left(-\frac{1}{2\sigma_\tau^2}(d_\tau - g(m_\tau))^T(d_\tau - g(m_\tau))\right)$$

where:

$m_\tau$ is the (L, θ) parameter vector at time τ, g(.) is the physical (electrical, pressure or acoustic) equation (i.e., $g_e(m)$, $g_p(m)$ or $g_s(m)$ ) linking the parameters to the data $d_\tau$ (i.e. $d_e(\tau)$, $d_p(\tau)$ or $d_s(\tau)$), and $^T$ represents the transpose symbol.

Determining the best set m of parameters and their associated uncertainties would normally be done by using classical methods of non-linear optimization. Because in this example there are only two parameters, L and θ, and since the forward modeling problems can be quickly solved, the inverse problem(s) can be graphically handled. Higher regions in the 3D plots below correspond to values of (L, θ) with higher probability and one looks for the (L, θ) pair that corresponds to the maximum probability, for an actual distance to the front of 70 m and a actual tilt angle of 20 degrees.

Figure 16:
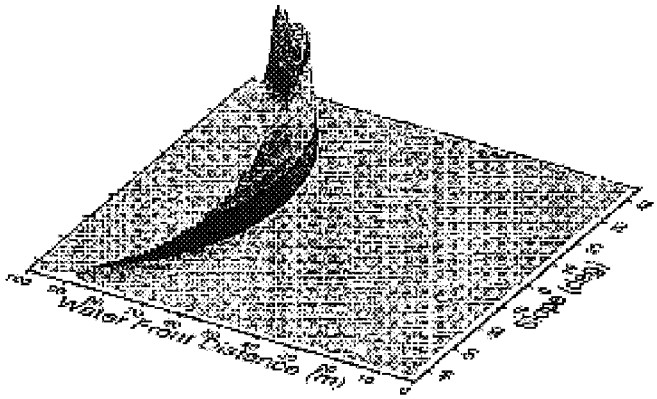
FIG. 16 shows the likelihood function for electric data with the waterfront at 70 m.
Figure 17:
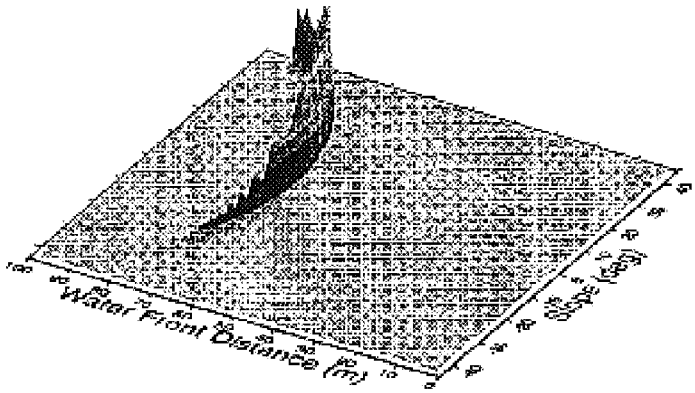
FIG. 17 shows the likelihood function for seismic data with the waterfront at 70 m.
Figure 18:
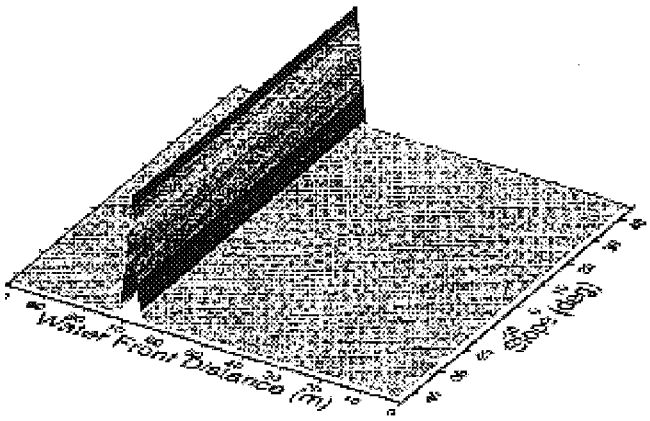
FIG. 18 shows the likelihood function for pressure data with the waterfront at 70 m.

FIGS. 16, 17, and 18 illustrate the individual likelihood functions for the electrical, seismic, and pressure data, when the front is at 70 m. As one may see from these Figures, there is uncertainty in the determination of the distance and the slope when the front is at a distance of approximately 70 m as the shape of the likelihood functions derived from individual monitoring do not accurately offer a point (vector) of expressing the distance and the slope that has the highest probability.

Figure 19:
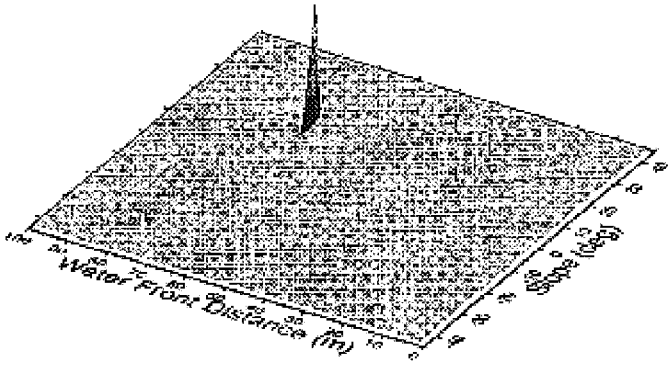
FIG. 19 shows the joint likelihood function for electric, seismic and pressure data with the waterfront at 70 m.

Now, since electrical data, seismic and pressure data are independent, their combination simply leads to a joint likelihood function that is the product of their respective likelihood functions, namely:

$$L(m,(\sigma_e,\sigma_p,\sigma_s)|d_e,d_p,d_s) \propto L(m,\sigma_e|d_e)\times L(m,\sigma_p|d_p)\times L(m,\sigma_s|d_s)$$

and the plot in FIG. 19 illustrating the joint likelihood function stems from a simple product of the previous ones. As one may see in the FIG. 19 the product of the likelihood functions (joint likelihood function) for electrical data, seismic and pressure data provides a more accurate determination of θ and L and as the graph of the joint likelihood in the figure displays a peak a close to the point where the distance is 70 m and the slope is approximately 20 degrees.

Figure 9:
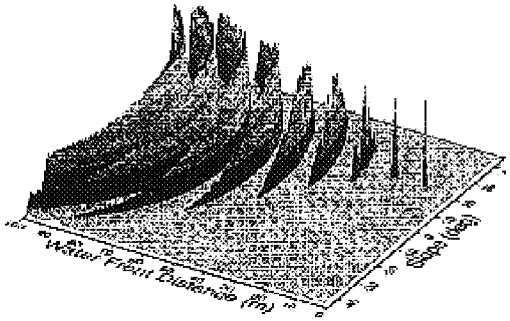
FIG. 9 shows a time-lapse probability density function for electrical data.
Figure 10:
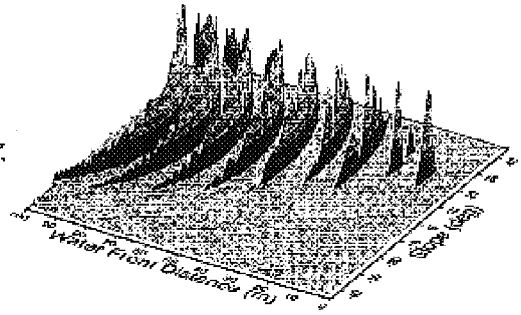
FIG. 10 shows a time-lapse probability density function for seismic data.
Figure 11:
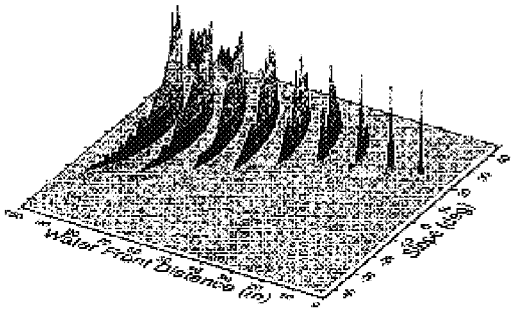
FIG. 11 shows a time-lapse probability density function for electrical and seismic data.
Figure 12:
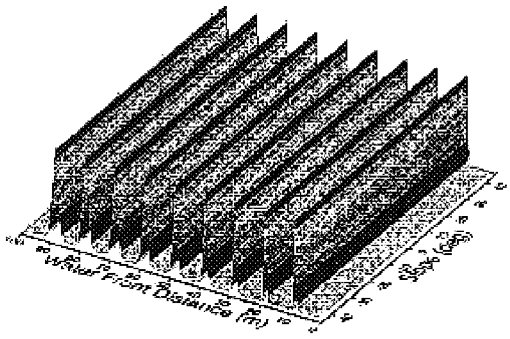
FIG. 12 shows a time-lapse probability density function for pressure data.
Figure 13:
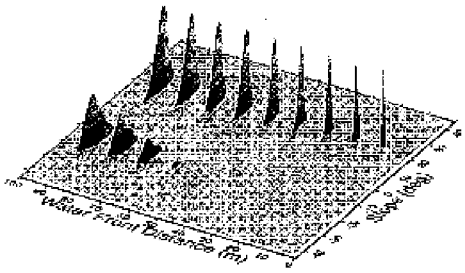
FIG. 13 shows a time-lapse probability density function for electrical and pressure data.
Figure 14:
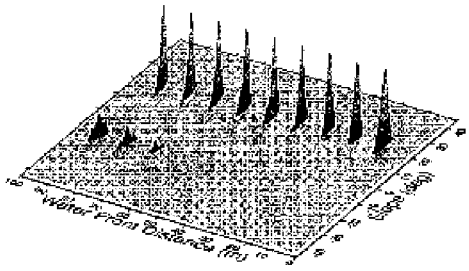
FIG. 14 shows a time-lapse probability density function for seismic and pressure data.
Figure 15:
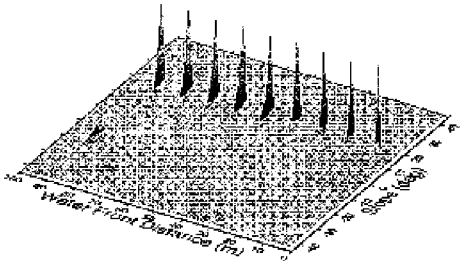
FIG. 15 shows a time-lapse probability density function for electrical, seismic and pressure data.

This has been then successively done for all sets of time-lapse data, first for the cases with electrical (FIG. 9), seismic (FIG. 10) or pressure (FIG. 11) data only, then with all combinations of two types of data (FIGS. 12, 13, and 14), and finally with all three types (FIG. 15). For the sake of figure compactness, we have furthermore combined, in each case, all the PDFs corresponding to the various survey times into a single plot, so as to better appreciate how the uncertainties on front distance and slope decrease when the waterfront approaches the well.

The electrical or seismic measurements are carrying information in both vertical and horizontal directions for a nearby front, but the information content decays rapidly with distance. For distances greater than 30 meters, there is a large set of equivalent models explaining the data. On the contrary, pressure data bear information allowing the determination of the horizontal distance to the front even when the front is still far away from the well but, due to the vertical resolution, it does not offer a complete solution to the front slope problem. The combination of electrical or/and seismic data with pressure ones, which is the subject of the embodiment of the present invention set forth herein, allows an accurate determination of both front slope and distance, over a wide range of distances.

Since, in practice, the applicability of the different reservoir monitoring techniques to the various reservoir situations differs, the combined approach to reservoir monitoring proposed in the embodiment of the present invention permits to benefit from their respective strengths for detecting fluid front movements.

From the foregoing, those skilled in the art will appreciate that the methods of the invention may be implemented with the aid of a general purpose data/signal processor(s) coupled to the apparatus shown in FIG. 2 and described above and utilizing the methods described above. These sensors described above in connection with the apparatus of FIG. 2 are coupled to a general purpose or special purpose processor or processors. The processor(s) may be a microprocessor, a signal processor, or an ASIC (application specific integrated circuit), or a combination of these. The processor(s) is (are) preferably coupled to a time base, input/output devices, and non-volatile memory. The time base is used for measuring the test times and for other processing tasks requiring time data. The I/O is used to input data regarding known reservoir parameters and to select the type of processing desired and to output the results of data analysis. The memory is used to store program information (if the programs are not hard coded into the processor circuitry) as well as data A methodology for combining different types of permanent downhole sensors to increase reservoir monitoring efficiency, has been illustrated by a simplified tutorial example where resistivity, seismic, and pressure sensor arrays are jointly used to track a water front movement towards a producing well: in this example, when the front is approaching, resistivity or seismics are gradually taking over from pressure as main information providers. By proposing a combination of time-lapse acquisition and interpretation of several types of monitoring data, the embodiment of the present invention set forth herein permits to consistently provide reliable front location estimates during the whole front displacement.

What is claimed is:

1. A method of monitoring a fluid front movement in a reservoir comprising:

determining at least two techniques for monitoring the fluid front movement;

determining a configuration of monitoring sensors, corresponding to the at least two monitoring techniques, from a joint sensitivity study of the at least two techniques considering the reservoir properties;

acquiring data with the monitoring sensors; and monitoring the fluid front by joint inverting the data.

2. A method as claimed in claim 1, wherein the step of determining at least two techniques includes assessing the sensitivity of various possible sensors appropriate for the monitoring of the fluid.

3. A method as claimed in claim 2, wherein the step of assessing includes determining sensitivity of the various possible sensors.

4. A method as claimed in claim 3, further including selecting a monitoring technique corresponding to an optimal sensitivity determined for a possible sensor.

5. A method as claimed in claim 1, wherein the step of determining a configuration of a monitoring sensor includes determining a numbers of monitoring sensors to be deployed.

6. A method as claimed in claim 1, wherein the step of determining a configuration further includes determining a spacing between said sensors to be deployed.

7. A method as claimed in claim 1, wherein the joint sensitivity study includes forward modeling.

8. A method as claimed in claim 1, wherein the step of acquiring data includes time lapse data acquisition.

9. A method as claimed in claim 8, wherein the data includes voltage, pressure, and acceleration.

10. A method as claimed in claim 1, wherein the step of monitoring the fluid front by joint inverting the data includes determining individual likelihood functions for each monitoring techniques.

11. A method as claimed in claim 10, further including determining a joint likelihood function from the individual likelihood functions.

12. A method as claimed in claim 11, wherein the joint likelihood function includes a product of the individual likelihood functions.

* * * * *